US009670851B2

(12) United States Patent
de Ojeda et al.

(10) Patent No.: US 9,670,851 B2
(45) Date of Patent: Jun. 6, 2017

(54) SYSTEM AND METHOD OF CONTROLLING COMBUSTION IN AN ENGINE HAVING AN IN-CYLINDER PRESSURE SENSOR

(75) Inventors: William de Ojeda, Oak Park, IL (US); Raul Espinosa, Chicago, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 702 days.

(21) Appl. No.: 14/114,474

(22) PCT Filed: Apr. 28, 2011

(86) PCT No.: PCT/US2011/034256

§ 371 (c)(1),
(2), (4) Date: Oct. 28, 2013

(87) PCT Pub. No.: WO2012/148396

PCT Pub. Date: Nov. 1, 2012

(65) Prior Publication Data

US 2014/0053811 A1 Feb. 27, 2014

(51) Int. Cl.

| | |
|---|---|
| ***F02D 41/00*** | (2006.01) |
| ***F02D 35/02*** | (2006.01) |
| *F02D 41/40* | (2006.01) |

(52) U.S. Cl.

CPC ..... *F02D 41/00* (2013.01); *F02D 35/023* (2013.01); *F02D 35/028* (2013.01); (Continued)

(58) Field of Classification Search

CPC ..... F02D 41/00; F02D 35/023; F02D 35/028; F02D 41/0007; F02D 41/0052; (Continued)

(56) References Cited

U.S. PATENT DOCUMENTS 5,642,705 A * 7/1997 Morikawa ..... F02B 17/005 123/300
6,994,077 B2 * 2/2006 Kobayashi ..... F02D 35/023 123/568.11

(Continued)

*Primary Examiner* — Hung Q Nguyen
*Assistant Examiner* — John Bailey
(74) *Attorney, Agent, or Firm* — Jack D. Nimz; Jeffrey P Calfa

(57) ABSTRACT

A control system for an internal combustion engine comprises pressure sensing means, memory means, processing means, and fuel injection control means. Pressure sensing means generate in-cylinder pressure data used to calculate total heat generated during combustion cycle. Memory means store predetermined crank angle data, such as CA50 crank angle data, for variety of engine operating conditions. A CA50 crank angle is a crank angle position where fifty percent of total heat is generated. Memory means additionally stores allowable start of injection crank angle data. Processing means determine an observed CA50 crank angle. Processing means conducts comparison of at least one of the predetermined CA50 crank angle data against the observed CA50 crank angle to generate a start of fuel injection crank angle which impacts the observed CA50 crank angle during subsequent combustion cycle. Fuel injection control means controls start of fuel injection crank angle generated by the processing means.

13 Claims, 7 Drawing Sheets

(52) U.S. Cl.
CPC ..... *F02D 41/0007* (2013.01); *F02D 41/0052* (2013.01); *F02D 41/401* (2013.01)

(58) Field of Classification Search
CPC .... F02D 41/401; F02D 35/024; F02D 35/025; F02D 35/026; F02D 35/027; F02D 41/005; F02D 41/0047; F02D 41/0057; F02D 41/0062; F02D 2041/0067; F02D 2041/007; F02D 41/0072; F02D 41/0077; F02D 41/26; F02D 41/30; F02D 41/34; F02D 41/36; F02D 41/40; F02D 41/38; F02D 41/345; F02D 41/365; F02D 41/3809; F02D 41/3818; F02D 41/3827; F02D 41/402; F02D 41/403; F02D 41/405; F02D 23/00; F02D 23/02
USPC ..... 123/434, 435, 679, 445, 305, 464, 123/568.11; 701/99, 101, 103, 104, 105
See application file for complete search history.

(56) References Cited

U.S. PATENT DOCUMENTS 7,146,964 B2 * 12/2006 Norimoto ..... F02D 35/023 123/435
7,325,529 B2 * 2/2008 Ancimer ..... F02B 23/0675 123/299
7,347,185 B2 * 3/2008 Moriya ..... F02P 5/1502 123/406.41
7,475,671 B1 * 1/2009 Fattic ..... F02D 35/026 123/406.47
7,509,938 B2 * 3/2009 Morimoto ..... F02D 35/028 123/299
8,904,995 B2 * 12/2014 Nada ..... F02D 41/3035 123/299
2003/0115873 A1 * 6/2003 Buckland ..... F01D 17/14 60/605.2
2003/0196635 A1 * 10/2003 Kataoka ..... F02B 47/08 123/299
2005/0092286 A1 * 5/2005 Sasaki ..... F02D 35/02 123/295
2005/0205053 A1 9/2005 Liu
2005/0229903 A1 * 10/2005 Kobayashi ..... F02D 35/023 123/435
2005/0274352 A1 * 12/2005 Canale ..... F02D 35/023 123/299
2006/0112928 A1 * 6/2006 Coleman ..... F02B 1/12 123/305
2006/0150953 A1 * 7/2006 Moriya ..... F02D 41/40 123/435
2007/0006851 A1 * 1/2007 Okamura ..... F02D 41/40 123/478
2007/0089697 A1 * 4/2007 Hara ..... F02D 35/023 123/90.15
2008/0082250 A1 * 4/2008 Husted ..... F02D 35/023 701/115
2008/0167786 A1 * 7/2008 Sasaki ..... F02D 35/023 701/102
2008/0243358 A1 * 10/2008 Kojima ..... F02D 35/025 701/102
2009/0078235 A1 * 3/2009 Moriya ..... F02D 35/023 123/406.44
2009/0292447 A1 * 11/2009 Yamaguchi ..... F02D 35/023 701/103
2010/0089362 A1 * 4/2010 Haskara ..... F02D 35/023 123/435
2010/0116249 A1 * 5/2010 Guerrassi ..... F02D 35/023 123/435
2010/0191478 A1 * 7/2010 Emery ..... F02D 35/023 702/24
2010/0312454 A1 * 12/2010 Nada ..... F02D 41/403 701/103
2011/0168129 A1 * 7/2011 Kurtz ..... F02D 19/061 123/294
2011/0320108 A1 * 12/2011 Morinaga ..... F02D 41/0057 701/105
2012/0004826 A1 * 1/2012 Shimo ..... F02D 41/3035 701/103
2012/0016571 A1 * 1/2012 Nada ..... F02D 41/3035 701/104

* cited by examiner

SYSTEM AND METHOD OF CONTROLLING COMBUSTION IN AN ENGINE HAVING AN IN-CYLINDER PRESSURE SENSOR

TECHNICAL FIELD

The present disclosure relates to a system and method of controlling combustion within an internal combustion engine having an in-cylinder pressure sensor for monitoring combustion occurring within a cylinder, such that adjustments may be made to operating parameters of the internal combustion engine. The adjustments of the operating parameters allow combustion to function properly, i.e. without an usually high number of misfires, while allowing a very high rate of exhaust gas recirculation ("EGR") to be used in combustion, and allowing fuel injection to begin after a cylinder has passed top dead center.

BACKGROUND

Many modern diesel engines have an exhaust system that features an exhaust gas recirculation ("EGR") system that routes a portion of engine exhaust gas into an air intake system, such that a mixture of fresh air and engine exhaust is supplied to a combustion chamber during engine operation. In order to reduce certain pollutants found in exhaust gas of an internal combustion engine, such as NOx and particulate matter, several approaches have been tried, including using an after-treatment chemical in conjunction with a catalytic converter, a system often referred to as a selective catalyst reduction system or an "SCR system." An SCR system adds complexity to an engine, and requires a catalyst that must be periodically replenished, which increases operating costs. If the catalyst is not replenished, the engine exhaust typically will not meet emissions standards, and the engine may be required to cease operations.

Therefore, a need exists for an engine capable of meeting emissions standards without the use of an after-treatment system to control parameters useful in reducing emissions of the engine.

SUMMARY

According to one embodiment, a control system for an internal combustion engine comprises pressure sensing means, memory means, processing means, and fuel injection control means. The pressure sensing means generate in-cylinder pressure data used to calculate the total heat generated during a combustion cycle. The memory means stores predetermined CA50 crank angle data for a variety of engine operating conditions. A CA50 crank angle is a crank angle position where fifty percent of the total heat during a combustion cycle is generated. The memory means additionally stores allowable start of injection crank angle data. The processing means determines an observed CA50 crank angle. The processing means conducts a comparison of at least one of the predetermined CA50 crank angle data against the observed CA50 crank angle to generate a start of fuel injection crank angle which impacts the observed CA50 crank angle during a subsequent combustion cycle. The fuel injection control means controls the start of fuel injection crank angle generated by the processing means.

According to one process, a method of controlling operation of an internal combustion engine is provided. An angular position of a crankshaft of the engine is monitored using a crank position sensor. A pressure reading is generated with a first in-cylinder pressure sensor for a first cylinder. An electronic control module is utilized to calculate the heat generated during the combustion cycle within the first cylinder based upon the pressure reading. An observed crank angle within the first cylinder is determined with the electronic control module based upon output of the crank position sensor and the first in-cylinder pressure sensor, wherein the observed crank angle is a crank angle position where a predetermined percent of the total heat is generated. The observed crank angle is compared against a predetermined crank angle stored in the electronic control module. A provisional start of injection crank angle is generated for the first cylinder in response to the comparison of the observed crank angle and the predetermined crank angle. A difference between the provisional start of injection crank angle of the first cylinder is compared to an average start of injection crank angle for a remainder of a plurality of cylinders to a preset phasing limit value. The fuel injector is utilized to match an actual start of fuel injection crank angle in the first cylinder to the provisional start of injection crank angle when the difference between the provisional start of injection crank angle and the average start of injection crank angle for the remainder of the plurality of cylinders is less than the preset phasing limit value.

According to another process, a method of controlling operation of an internal combustion engine is provided. An angular position of a crankshaft of the engine is monitored using a crank position sensor. A pressure reading is generated with a first in-cylinder pressure sensor for a first cylinder. An electronic control module is utilized to calculate the heat generated during the combustion cycle within the first cylinder based upon the pressure reading. An observed CA50 crank angle within the first cylinder is determined with the electronic control module based upon output of the crank position sensor and the first in-cylinder pressure sensor. The observed CA50 crank angle is compared against a predetermined CA50 crank angle stored in the electronic control module. A provisional start of injection crank angle is generated for the first cylinder in response to the comparison of the observed CA50 and the predetermined CA50. The provisional start of injection crank angle for the first cylinder is compared to a range of predetermined start of injection crank angles stored in the electronic control module. A difference between the provisional start of injection crank angle of the first cylinder is compared to an average start of injection crank angle for a remainder of a plurality of cylinders to a preset phasing limit value. The fuel injector is utilized to match an actual start of fuel injection crank angle in the first cylinder to the provisional start of injection crank angle when the provisional start of injection crank angle is within the range of predetermined start of injection crank angles, and when the difference between the provisional start of injection crank angle and the average start of injection crank angle for the remainder of the plurality of cylinders is less than the preset phasing limit value. An exhaust gas recirculation valve position is generated for the first cylinder when one of the difference between the provisional start of injection crank angle for the first cylinder and the average start of injection crank angle for the remainder of the plurality of cylinders exceeds the preset phasing limit and the provisional start of injection crank angle is outside of the range of predetermined start of injection crank angles. The fuel injector is utilized to match an actual start of fuel injection crank angle into the first cylinder to an adjusted start of injection crank angle when one of the difference between the provisional start of injection crank angle for the first cylinder and the average start of injection crank angle for the remainder of the plurality of cylinders exceeds the preset phasing limit, and the provisional start of injection crank angle is outside of the range of predetermined start of injection crank angles. A position of the exhaust gas recirculation valve is adjusted to the generated exhaust gas recirculation valve position.

DETAILED DESCRIPTION

Figure 1:
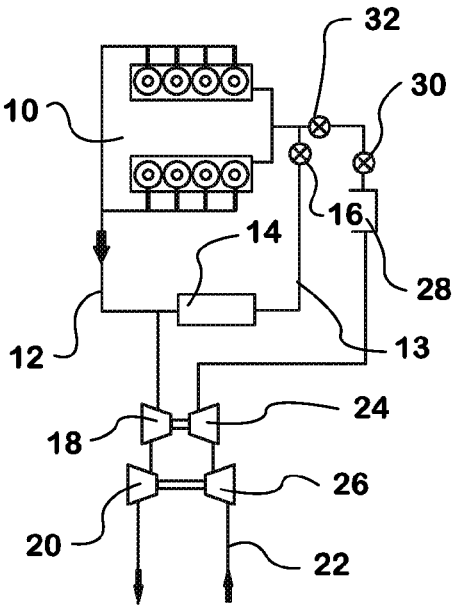
FIG. 1 is a schematic diagram showing an engine.

FIG. 1 shows an engine 10 having an exhaust system 12. The exhaust system 12 has an exhaust gas recirculation ("EGR") portion 13. The EGR portion 13 has an EGR cooler 14 and an EGR valve 16. The EGR cooler 14 reduces the temperature of exhaust gas within the EGR portion 13. The exhaust system 12 additionally is shown as having a first turbocharger turbine 18 and a second turbocharger turbine 20. The EGR valve 16 controls the flow of exhaust gas within the EGR portion 13.

The engine 10 additionally has an air intake system 22. The air intake system 22 has a first turbocharger compressor 24 and a second turbocharger compressor 26. A charge air cooler 28 is additionally provided to cool intake air within the air intake system 22. A first throttle valve 30 and a second throttle valve 32 are also disposed within the air intake system 22. The first turbocharger turbine 18 and the first turbocharger compressor 24 form a first turbocharger and the second turbocharger turbine 20 and the second turbocharger compressor 26 form a second turbocharger. It is contemplated that the first turbocharger and the second turbocharger may be variable geometry turbochargers.

Figure 2:
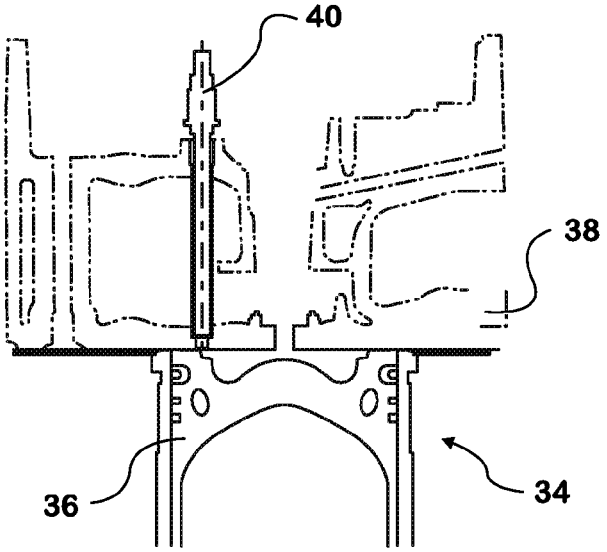
FIG. 2 is a sectional view of an engine showing a cylinder having an in-cylinder pressure sensor.

Turning now to FIG. 2, a cross section of a cylinder 34 of the engine 10. The cylinder 34 has a piston 36 that moves reciprocally within the cylinder 34. A cylinder head 38 is disposed above the cylinder 34, such that the movement of the piston 36 within the cylinder 34 increases a pressure within the cylinder 34. An in-cylinder pressure sensor 40 is additionally provided. The in-cylinder pressure sensor 40 is disposed within the cylinder head 38 and a portion of the in-cylinder pressure sensor 40 is exposed within the cylinder 34. The in-cylinder pressure sensor 40 monitors the pressure within the cylinder 34. In a multi-cylinder engine 10, there are multiple sensors 40 forming a sensor group 41.

Figure 3:
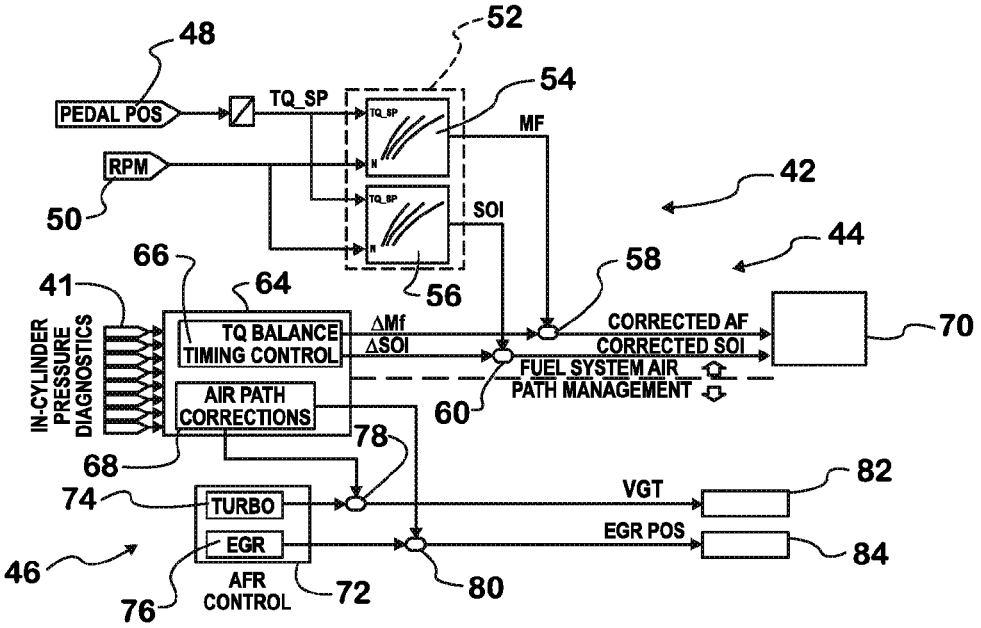
FIG. 3 is block diagram showing a control system for an engine having an in-cylinder pressure sensor.
Figure 6A:
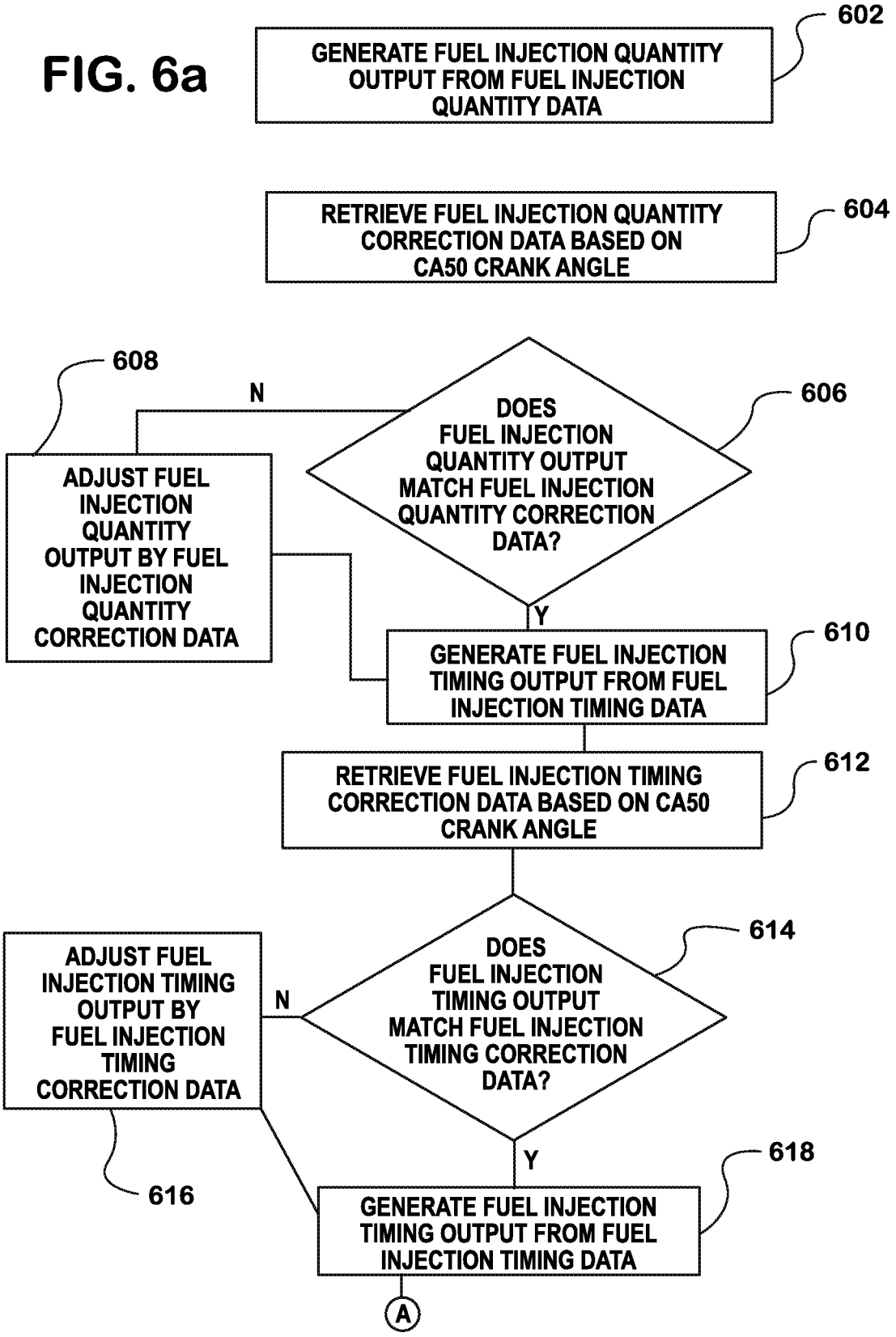
FIGS. 6*a* and 6*b* are a flow chart showing one process of controlling an engine.
Figure 6B:
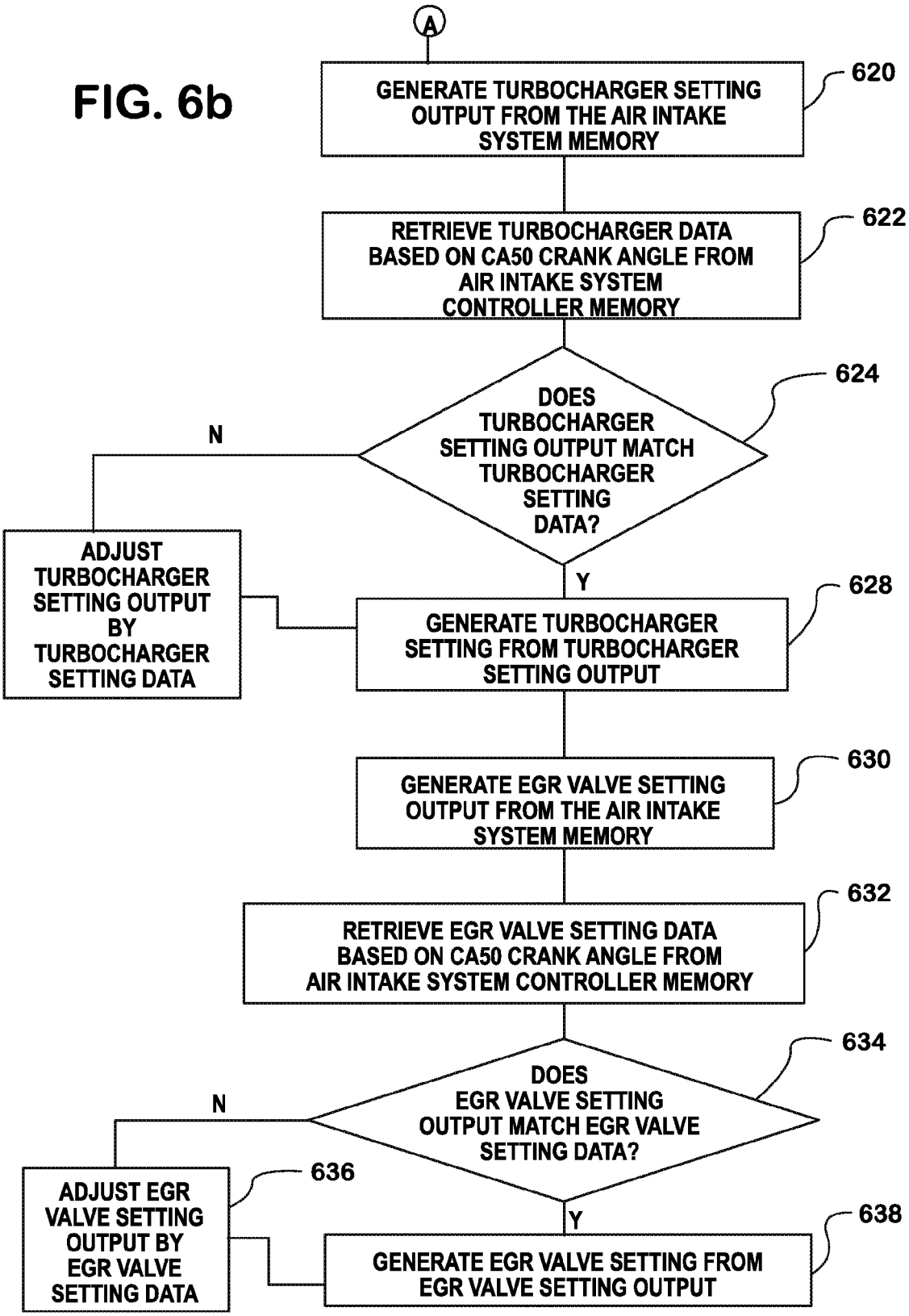

FIG. 3 depicts a block diagram for a control system 42 for the engine 10, while FIGS. 6*a* and 6*b* depict a flow chart of a method of controlling the engine 10. The control system 42 has a fuel system control component 44 and an air system control component 46. The fuel system control component 44 has an accelerator position sensor 48 and an engine speed sensor 50. The accelerator position sensor 48 and the engine speed sensor 50 are in electrical communication with a fuel system controller 52. The fuel system controller 52 has a memory that stores fuel injection quantity data 54 as well as fuel injection timing data 56, wherein both data 54, 56 are graphically represented with curves. Based upon the input received from the accelerator position sensor 48 and the engine speed sensor 50, the fuel system controller 52 retrieves a fuel injection quantity output from the fuel injection quantity data 54 (block 602, FIG. 6*a*) and also retrieves a fuel injection timing output from the fuel injection timing data 56 (block 610, FIG. 6*a*). The fuel injection quantity output is communicated to a fuel injection quantity comparator 58, while the fuel injection timing output is communicated to a fuel injection timing comparator 60.

The fuel system control component 44 additionally utilizes the group 41 of in-cylinder pressure sensors 40 that communicate with a combustion monitoring processor 64 that contains a fuel system memory 66 containing fuel injection timing correction data (block 612, FIG. 6*a*) and fuel injection quantity correction data (block 604, FIG. 6*a*) based upon the output of the group 41 of in-cylinder pressure sensors 40. Outputs of the fuel system memory 66 is electronically communicated to the fuel injection quantity comparator 58 and the fuel injection timing comparator 60 (block 614, FIG. 6*a*). The fuel injection quantity comparator 58 compares the output of the fuel injection quantity data 54 with the output from the fuel system memory 66 of the combustion monitoring processor 64 (block 606, FIG. 6*a*) to generate a corrected fuel injection quantity communicated to a fuel injector 70 (blocks 608, 610, FIG. 6*a*). Similarly, the fuel injection timing comparator 60 compares the output of the fuel injection timing data 56 with the output from the fuel system memory 66 of the combustion monitoring processor 64 (block 614, FIG. 6*a*) to generate a corrected fuel injection timing communicated to a fuel injector 70 (blocks 616, 618, FIG. 6*a*).

The air system control component 44 of the control system 42 for the engine 10 additionally utilizes the group 41 of in-cylinder pressure sensors 40 that communicate with the combustion monitoring processor 64 that has an air intake system memory 68 (blocks 620, 630, FIG. 6*b*). An air intake system controller 72 has a memory that stores turbocharger data 74 as well as EGR system data 76. The air intake system controller 72 retrieves a turbocharger setting from the turbocharger data 74 based upon engine operating conditions (block 622, FIG. 6*b*). The air intake system controller 72 additionally retrieves an EGR valve setting from the EGR system data 76 (block 632, FIG. 6*b*). Output of the turbocharger data 74 and the air intake system memory 68 is transmitted to a turbocharger comparator 78 which compares the turbocharger data 74 with the output of the air intake system memory 68 (block 624, FIG. 6*b*) and may adjust the turbocharger setting output using the turbocharger data 74 (block 626, FIG. 6*b*) to generate a corrected turbocharger setting to a turbocharger 82 (block 628, FIG. 6*b*).

The EGR system data 76 from the air intake system controller 72 is transmitted to an EGR system comparator 80 where the EGR system comparator 80 compares it to the output of the air intake system memory 68 (block 634, FIG. 6*b*) and may adjust the EGR setting output using the EGR system data 76 (block 636, FIG. 6*b*) to generate a corrected EGR system setting to an EGR valve 84 (block 638, FIG. 6*b*).

Figure 4:
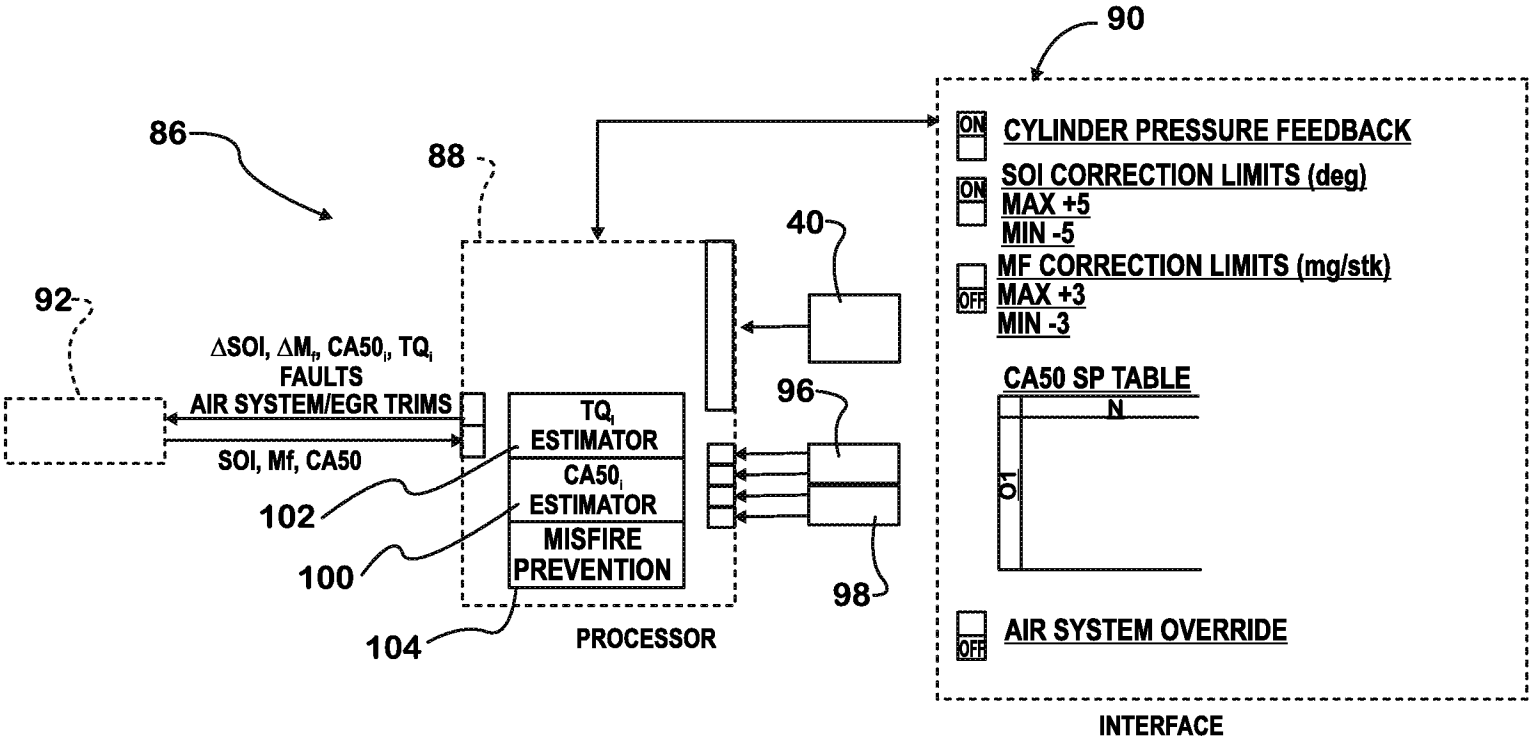
FIG. 4 is block diagram showing a control system for an engine having an in-cylinder pressure sensor according to another embodiment.

Turning now to FIG. 4, a control system 86 is shown having a processor 88, an interface 90, and an ECM 92. The processor 88 is disposed in electrical communication with both the interface 90 and the ECM 92. The processor 88 is additionally disposed in electrical communications with an in-cylinder pressure sensor 40, a cam position sensor 96 and a crank position sensor 98. The processor 88 utilizes the input from the in-cylinder pressure sensor 40, the cam position sensor 96, and the crank position sensor 98 to generate a CA50 crank angle using a CA50 estimator 100 of the processor 88.

The CA50 crank angle is the crank angle where 50% of the heat is generated for a particular combustion cycle. In order to determine when 50% of the heat has been generated, the in-cylinder pressure sensor 40 is utilized to determine a total heat release for the combustion of fuel within the cylinder 34 based upon the pressure within the cylinder 34. The output of the in-cylinder pressure sensor 40 may also be utilized by a torque estimator 102 of the processor 88.

While the CA50 crank angle is described in this disclosure, it is contemplated that a different crank angle may be utilized that corresponds to a specific percentage of heat generated for a particular combustion cycle, and the invention is not limited to the specific crank angles or specific percentages heat generated. For instance, it is additionally contemplated that a range of a CA10 crank angle to a CA90 crank angle may be utilized, wherein the CA10 crank angle is the crank angle where 10% of the heat is generated for a particular combustion cycle, and CA90 is the crank angle where 90% of the heat is generated for a particular combustion cycle. Therefore, it is contemplated that CA50 may be substituted by a crank angle (CA) corresponding to another predetermined percentage amount of heat generated during combustion without altering the principals of this disclosure.

The in-cylinder pressure sensor 40 is utilized to determine the pressure within the cylinder from combustion by comparing the actual pressure within the cylinder, to the pressure that would be within the cylinder without any combustion occurring. This is done by comparing the output of the in-cylinder pressure sensor 40 at a crank angle after a piston within the cylinder has passed top dead center ("TDC") with the output of the in-cylinder pressure sensor 40 at a corresponding crank angle before the position within the cylinder has reached TDC. For example, the output of the in-cylinder pressure sensor 40 at a crank angle 25 degrees after TDC is compared to the output of the in-cylinder pressure sensor 40 at a crank angle 25 degrees before TDC, wherein the pressure difference is based upon combustion of fuel within the cylinder 34. The pressure within the cylinder 34 attributed to combustion from the in-cylinder pressure sensor 40 may be used to generate a heat release amount, such that a crank angle may be determined where various percentages of the total amount of heat released from a particular fuel injection into a particular cylinder may be calculated. Thus, the CA50 estimator 100 may calculate a CA50 crank angle that corresponds to the crank angle where 50% of the heat released during combustion of a particular combustion cycle within a particular cylinder occurs.

Similarly, the torque estimator 102 may utilize the output of the in-cylinder pressure sensor 40 to calculate a torque output of the engine 10. The torque estimator 102 utilizes the output of the in-cylinder pressure sensor 40 and a known equation of the relationship between pressure within the cylinder 34 and the geometry the engine 10 to calculate an estimate of torque produced by the engine 10. The torque can be calculated by the following formula: Torque=BMEP*V/4Π, where BMEP is the brake mean effective pressure and V is the volume of the piston. BMEP may be calculated using the formula BMEP=IMEP−FMEP, where IMEP is the indicated mean effective pressure and FMEP is the friction mean effective pressure. IMEP may be generated from the output of the in-cylinder pressure sensor 40 when fuel in injected into a cylinder 34, and FMEP may be calculated using the in-cylinder pressure sensor 40 when no fuel is injected into a cylinder 34 during a cycle, or may be estimated.

The processor 88 still further has a misfire prevention module 104 adapted to monitor combustion characteristics within the engine 10. The misfire prevention module 104 is adapted to compare an output of the CA50 estimator 100 with an output from the ECM 92 that contains a target CA50 value retrieved from a memory of the ECM 92. The misfire prevention module 104 will generate an output signal to adjust at least one of fuel injection timing, EGR valve position, VGT settings, and variable valve timing settings to adjust the actual CA50 value calculated by the CA50 estimator 100 to match the target CA50 value stored in a memory of the ECM 92 as will be explained in further detail below.

The interface 90 of the control system 86 allows for control of parameters used for the misfire prevention module 104 of the processor 88. The interface 90 allows limits for the adjustments of the fuel injection timing, and airflow to the engine 10 to be corrected. The interface 90 additionally allows in-cylinder pressure sensor 40 feedback to be turned on and off, depending on expected operating conditions of the engine 10.

Figure 5:
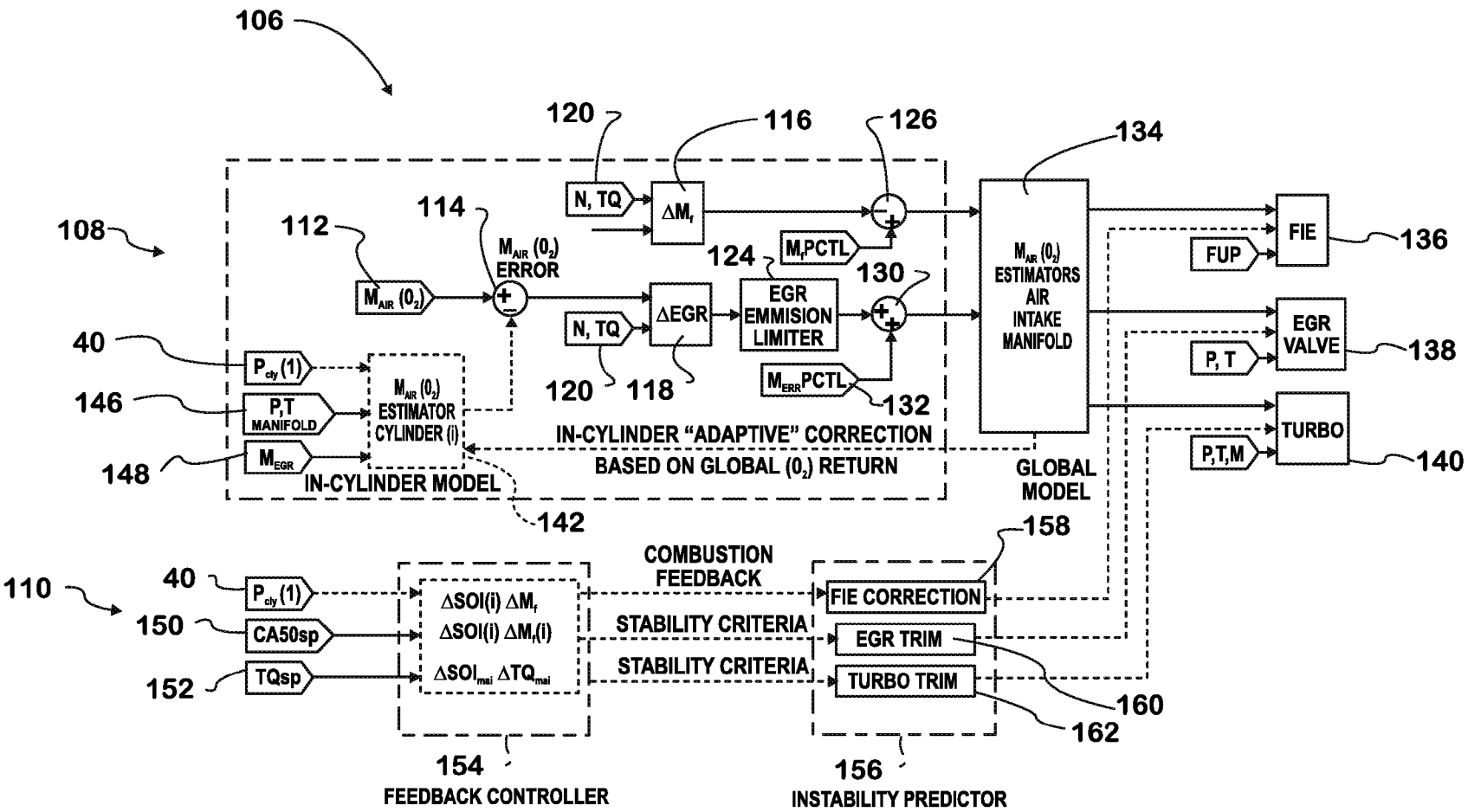
FIG. 5 is a block diagram showing a control system for an engine having an in-cylinder pressure sensor according to a further embodiment.

FIG. 5 shows a schematic of a control system 106 for a diesel engine. The control system 106 is adapted to control combustion phasing, that is the crank angle where CA50 occurs in cylinders within the engine. Combustion phasing may also be controlled between cylinders of a multi-cylinder engine, such that CA50 crank angle for a first cylinder is within a predefined number of degrees from the CA50 crank angle for a second cylinder. Using both a model based portion 108 and an empirical portion 110 of the control system 106, combustion within the engine is controlled.

The model based portion 108 has a memory that contains an air flow estimate 112 based upon observed operating conditions of the engine 10, such as torque output, and engine speed. The output of the air flow estimate 112 is transmitted to an air flow comparator 114. As explained below, the air flow comparator 114 also receives an input based upon air flow estimated by the in-cylinder pressure sensor 40. The output of the air flow comparator 114 is transmitted to a throttle controller 116 and an EGR controller 118. The throttle controller 116 receives input from an engine speed and torque monitor 120, while the EGR controller 118 further receives input from an engine speed and torque monitor 120.

Output from the EGR controller 118 is transmitted to an EGR emission limiter 124, to ensure that the EGR setting is sufficient to allow the engine to meet emission standards. Output of the throttle controller 116 is transmitted to an intake air comparator 126 where it is compared to a predetermined intake air setting 128. Output of the intake air comparator 126 is transmitted to an intake manifold air estimator 134.

Similarly, output from the EGR emission limiter 124 is transmitted to an EGR comparator 130 where it is compared to a predetermined EGR setting 132. Output of the EGR comparator 130 is also transmitted to the intake manifold air estimator 134. Output from the intake manifold air estimator 134 is transmitted to a fuel injector controller 136, and EGR valve controller 138, and a variable geometry turbocharger (VGT) controller 140, to be used in helping to control fuel injection timing, the amount of EGR delivered to the engine, and the VGT setting.

The intake manifold air estimator 134 also communicates with an in-cylinder pressure sensor based air estimator 142. The in-cylinder pressure sensor based air estimator 142 also receives input from an in-cylinder pressure sensor 40, an intake manifold pressure sensor 146, and an EGR rate estimator 148. The in-cylinder pressure sensor based air estimator 142 generates an output that is communicated with the airflow comparator 114, so that the airflow comparator 114 may calculate a correction to the air flow estimate 112 stored in the memory. The correction of the airflow estimate 112 allows for better control of the air/fuel ratio of the engine.

Figure 7A:
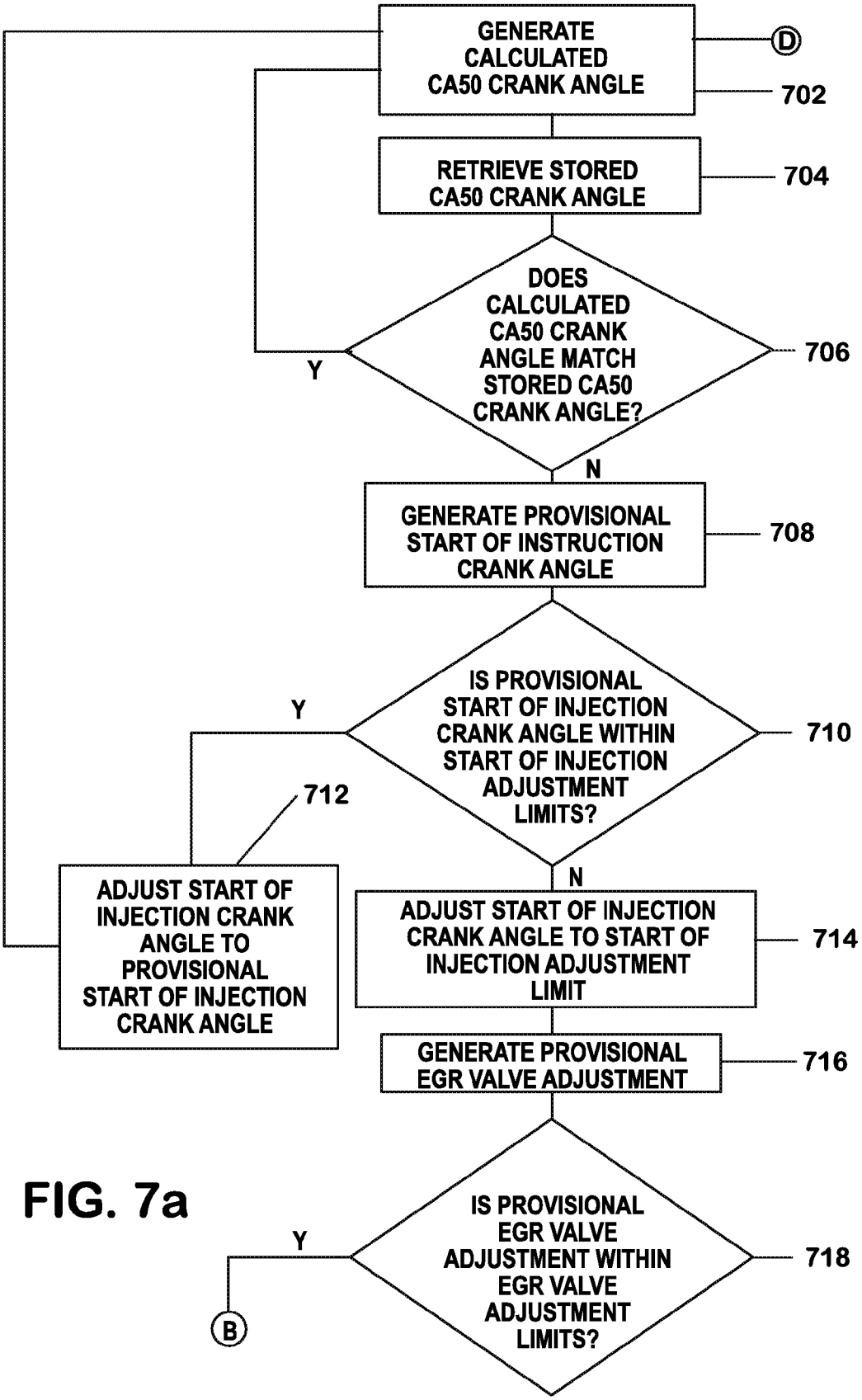
FIGS. 7*a* and 7*b* are a flow chart showing another process of controlling an engine.
Figure 7B:
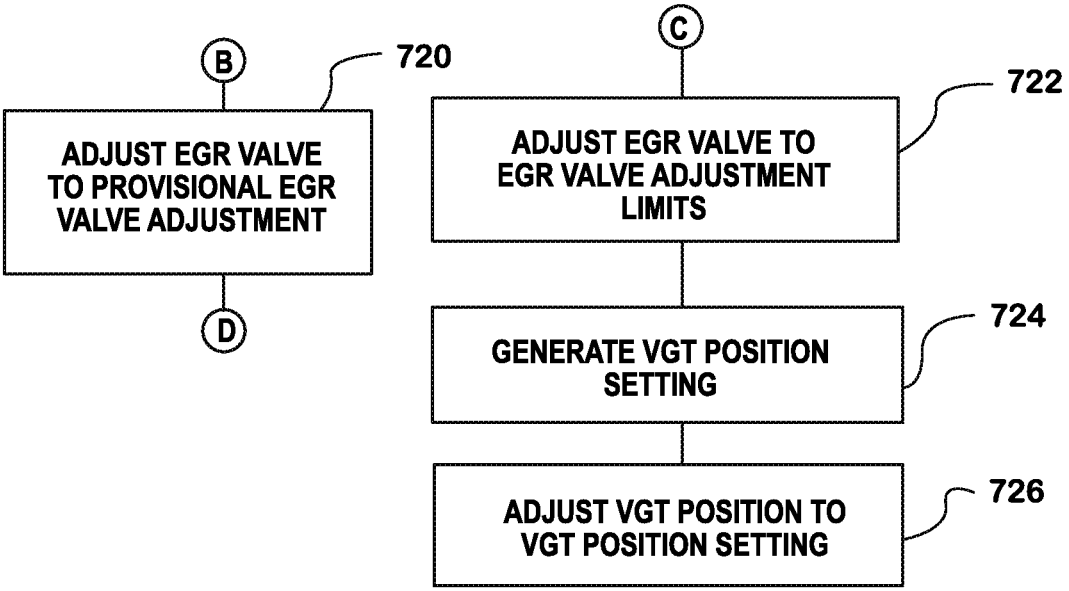

Turning now to the empirical portion 110 of the control system 106, as well as the flow chart shown in FIGS. 7*a* and 7*b*, input from the in-cylinder pressure sensor 40, a calculated CA50 value 150 (block 702, FIG. 7*a*), and a calculated torque 152 are transmitted to a feedback controller 154. The feedback controller 154 compares the calculated CA50 value 150 with a stored CA50 value based on observed engine operating conditions (block 704, FIG. 7*a*) and may adjust the turbocharger setting output using the turbocharger setting data 74 (block 706, FIG. 7*a*). If the calculated CA50 value 150 generally corresponds to the stored CA50 value, very few adjustments, or even no adjustments, are made to operating parameters. However, if the calculated CA50 value 150 does not correspond to the stored CA50 value, the feedback controller 154 generates a provisional start of injection crank angle (block 708, FIG. 7*a*), and compares the provisional start of injection crank angle to a start of injection adjustment limit stored in a memory of the feedback controller 154 (block 710, FIG. 7*a*). If the provisional start of injection crank angle is within the start of injection adjustment limit, the start of injection crank angle is adjusted (block 712, FIG. 7*a*). If the provisional start of injection crank angle is not within the start of injection adjustment limit, the feedback controller 154 generates a provisional EGR valve adjustment (block 716, FIG. 7*a*), and sets the start of injection crank angle at the adjustment limit (block 714, FIG. 7*a*).

The provisional EGR valve adjustment is also compared to an EGR valve adjustment limit (block 718, FIG. 7*a*). If the provisional EGR valve adjustment is within the EGR valve adjustment limit, the EGR valve is set to the provisional EGR valve adjustment position (block 720, FIG. 7*b*). However, if the provisional EGR valve adjustment is outside of the EGR valve adjustment limit, the feedback controller 154 generates a VGT position setting (block 724, FIG. 7*b*), and sets the EGR valve adjustment position at the adjustment limit (block 722, FIG. 7*b*). The VGT position is set at the generated VGT position setting (block 726, FIG. 7*b*).

The feedback controller 154 communicates with an instability predictor 156. The instability predictor 156 is used by an engine having a plurality of cylinders to compare the corrections required by one cylinder to settings for the remaining cylinders. If the instability predictor 156 detects that the setting for the start of injection crank angle for a first cylinder is outside of a range from an average start of injection crank angle for all of the cylinders of the engine, the instability predictor 156 will set an adjusted start of injection crank angle, and will adjust at least one of the EGR valve adjustment and the VGT position setting to compensate for the adjusted start of injection crank angle. The instability predictor 156 therefore generates a final start of injection crank angle 158, a final EGR valve adjustment position 160, and a final VGT position setting 162. The final start of injection crank angle 158 is transmitted to the fuel injector controller 136, the final EGR valve adjustment position 160 is transmitted to the EGR valve controller 138, and the final VGT position setting 162 is transmitted to the VGT controller 140.

It is additionally contemplated that an intake throttle position setting and a variable valve actuation setting may also be generated as described above with respect to the EGR valve position and the VGT position setting. It is contemplated that the control system 106 may be executed by an ECM, or that separate controllers may be utilized that simply communicate with each other.

The present disclosure is adapted to allow an engine to operate with high levels of EGR, i.e. above 35%, and with a start of fuel injection occurring after a piston within a cylinder has passed top dead center. These aspects of this disclosure allow combustion to remain stable, even with fuel injection starting after the piston has passed top dead center. Fuel injection occurring after the piston has passed top dead center while utilizing EGR rates above 35% have been found to reduce engine emissions of NOx and particulate matter significantly. However, combustion tends to become unstable with increasing amounts of EGR as less oxygen is present within EGR for use in combustion. Additionally, initiating fuel injection after TDC may lead to unstable combustion as mixing of fuel with air within the cylinder may not sufficiently atomize the fuel for stable combustion to occur, thus, combustion under such conditions must be carefully monitored and controlled.

As described above, the present disclosure may be applied on a per-cylinder basis, such that fuel injection timing, and EGR valve position setting are adjusted to ensure proper combustion within a single cylinder, or operations of a plurality of cylinders may be controlled by an instability predictor to ensure that proper combustion phasing is maintained between the plurality of cylinders.

What is claimed is:

1. A method of controlling operation of an internal combustion engine, the method comprising:

monitoring an angular position of a crankshaft of the engine using a crank position sensor, generating a pressure reading with a first in-cylinder pressure sensor for a first cylinder;

utilizing an electronic control module to calculate a total heat generated during a combustion cycle within the first cylinder based upon the pressure reading;

determining an observed crank angle within the first cylinder with the electronic control module based upon output of the crank position sensor and the first in-cylinder pressure sensor, wherein the observed crank angle is a crank angle position where a predefined percent of the total heat is generated;

comparing the observed crank angle against a predetermined crank angle stored in the electronic control module, wherein the predetermined crank angle is a crank angle position where a predefined percent of the total heat is generated;

generating a provisional start of injection crank angle for the first cylinder in response to the comparison of the observed crank angle and the predetermined crank angle;

comparing a difference between the provisional start of injection crank angle of the first cylinder to an average start of injection crank angle for a remainder of a plurality of cylinders to a preset phasing limit value; and utilizing a fuel injector to match an actual start of fuel injection crank angle in the first cylinder to the provisional start of injection crank angle when the difference between the provisional start of injection crank angle and the average start of injection crank angle for the remainder of the plurality of cylinders is less than the preset phasing limit value.

2. The method of claim 1, wherein the observed crank angle is a crank angle position wherein 50% of the total heat is generated.

3. The method of claim 1 further comprising:

generating an exhaust gas recirculation valve position when the difference between the provisional start of injection crank angle for the first cylinder and the average start of injection crank angle for the remainder of the plurality of cylinders exceeds the preset phasing limit; and utilizing the fuel injector to adjust a start of fuel injection crank angle in the first cylinder to an adjusted start of injection crank angle when the difference between the provisional start of injection crank angle for the first cylinder and the average start of injection crank angle for the remainder of the plurality of cylinders exceeds the preset phasing limit; and wherein a difference between the adjusted start of injection crank angle and the average start of injection crank angle for the remainder of the plurality of cylinders is less than the preset phasing limit value.

4. The method of claim 1 further comprising:

generating a variable geometry turbo setting when the difference between the provisional start of injection crank angle for the first cylinder and the average start of injection crank angle for the remainder of the plurality of cylinders exceeds the preset phasing limit; and utilizing the fuel injector to adjust a start of fuel injection crank angle in the first cylinder to an adjusted start of injection crank angle when the difference between the provisional start of injection crank angle for the first cylinder and the average start of injection crank angle for the remainder of the plurality of cylinders exceeds the preset phasing limit;

wherein a difference between the adjusted start of injection crank angle and the average start of injection crank angle for the remainder of the plurality of cylinders is less than the preset phasing limit value.

5. The method of claim 4, wherein the predefined percent of the total heat generated crank angle is based upon engine torque output.

6. The method of claim 1 further comprising:

generating an intake throttle position setting when the difference between the provisional start of injection crank angle for the first cylinder and the average start of injection crank angle for the remainder of the plurality of cylinders exceeds the preset phasing limit; and utilizing the fuel injector to adjust a start of fuel injection crank angle in the first cylinder to an adjusted start of injection crank angle when the difference between the provisional start of injection crank angle for the first cylinder and the average start of injection crank angle for the remainder of the plurality of cylinders exceeds the preset phasing limit;

wherein a difference between the adjusted start of injection crank angle and the average start of injection crank angle for the remainder of the plurality of cylinders is less than the preset phasing limit value.

7. The method of claim 1 further comprising:

generating a variable valve actuation setting when the difference between the provisional start of injection crank angle for the first cylinder and the average start of injection crank angle for the remainder of the plurality of cylinders exceeds the preset phasing limit; and utilizing the fuel injector to adjust a start of fuel injection crank angle in the first cylinder to an adjusted start of injection crank angle when the difference between the provisional start of injection crank angle for the first cylinder and the average start of injection crank angle for the remainder of the plurality of cylinders exceeds the preset phasing limit;

wherein a difference between the adjusted start of injection crank angle and the average start of injection crank angle for the remainder of the plurality of cylinders is less than the preset phasing limit value.

8. The method of claim 1, wherein the preset phasing limit is based upon engine operating conditions.

9. The method of claim 1, wherein the preset phasing limit is based upon an operator input setting.

10. A method of controlling operation of an internal combustion engine, the method comprising:

monitoring an angular position of a crankshaft of the engine using a crank position sensor;

generating a pressure reading with a first in-cylinder pressure sensor for a first cylinder;

utilizing an electronic control module to calculate the total heat generated during a combustion cycle within the first cylinder based upon the pressure reading;

determining an observed CA50 crank angle within the first cylinder with the electronic control module based upon output of the crank position sensor and the first incylinder pressure sensor, wherein the CA50 crank angle is a crank angle position where fifty percent of the total heat is generated;

comparing the observed CA50 crank angle against a predetermined CA50 crank angle stored in the electronic control module;

generating a provisional start of injection crank angle for the first cylinder in response to the comparison of the observed CA50 and the predetermined CA50;

comparing the provisional start of injection crank angle for the first cylinder to a range of predetermined start of injection crank angles stored in the electronic control module;

comparing a difference between the provisional start of injection crank angle of the first cylinder to an average start of injection crank angle for a remainder of a plurality of cylinders to a preset phasing limit value;

utilizing a fuel injector to match an actual start of fuel injection crank angle in the first cylinder to the provisional start of injection crank angle when the provisional start of injection crank angle is within the range of predetermined start of injection crank angles and when the difference between the provisional start of injection crank angle and the average start of injection crank angle for the remainder of the plurality of cylinders is less than the preset phasing limit value;

generating an exhaust gas recirculation valve position when one of the difference between the provisional start of injection crank angle for the first cylinder and the average start of injection crank angle for the remainder of the plurality of cylinders exceeds the preset phasing limit and the provisional start of injection crank angle is outside of the range of predetermined start of injection crank angles;

utilizing the fuel injector to match an actual start of fuel injection crank angle into the first cylinder to an adjusted start of injection crank angle when one of the difference between the provisional start of injection crank angle for the first cylinder and the average start of injection crank angle for the remainder of the plurality of cylinders exceeds the preset phasing limit, and the provisional start of injection crank angle is outside of the range of predetermined start of injection crank angles; and adjusting position of the exhaust gas recirculation valve to the generated exhaust gas recirculation valve position.

11. The method of claim 10 further comprising:

generating a variable geometry turbocharger position when one of the difference between the provisional start of injection crank angle for the first cylinder and the average start of injection crank angle for the remainder of the plurality of cylinders exceeds the preset phasing limit and the provisional start of injection crank angle is outside of the range of predetermined start of injection crank angles; and adjusting a position of the variable geometry turbocharger to the generated variable geometry turbocharger position.

12. The method of claim 10 further comprising:

generating an intake throttle position when one of the difference between the provisional start of injection crank angle for the first cylinder and the average start of injection crank angle for the remainder of the plurality of cylinders exceeds the preset phasing limit and the provisional start of injection crank angle is outside of the range of predetermined start of injection crank angles; and adjusting a position of the intake throttle to the generated intake throttle position.

13. The method of claim 10 further comprising:

generating a variable valve actuation setting when one of the difference between the provisional start of injection crank angle for the first cylinder and the average start of injection crank angle for the remainder of the plurality of cylinders exceeds the preset phasing limit and the provisional start of injection crank angle is outside of the range of predetermined start of injection crank angles; and adjusting a variable valve actuation setting to the generated variable valve timing setting.

* * * * *